US008511003B2

(12) United States Patent
Trebil

(10) Patent No.: US 8,511,003 B2
(45) Date of Patent: Aug. 20, 2013

(54) WALL ANCHORING DEVICE AND METHOD OF INSTALLATION REQUIRING NO SOIL EXCAVATION

(76) Inventor: Jesse B. Trebil, Atwater, MN (US)

( * ) Notice: Subject to any disclaimer, the term of this patent is extended or adjusted under 35 U.S.C. 154(b) by 0 days.

(21) Appl. No.: 13/506,334

(22) Filed: Apr. 12, 2012

(65) Prior Publication Data

US 2013/0104466 A1 May 2, 2013

Related U.S. Application Data

(60) Provisional application No. 61/628,511, filed on Nov. 1, 2011.

(51) Int. Cl.
*E02D 5/74* (2006.01)
*E02D 27/00* (2006.01)

(52) U.S. Cl.
USPC ..... 52/166; 52/169.6; 52/514; 52/741.13; 405/262

(58) Field of Classification Search
USPC ..... 52/166, 169.6, 514, 741.13; 405/262, 405/259.1; D25/133
See application file for complete search history.

(56) References Cited

U.S. PATENT DOCUMENTS

| | | | | |
|---|---|---|---|---|
| 2,580,915 | A * | 1/1952 | Hocher | 52/159 |
| 3,507,121 | A * | 4/1970 | Morfeldt | 405/259.5 |
| 4,189,891 | A * | 2/1980 | Johnson et al. | 52/741.13 |
| 4,480,945 | A * | 11/1984 | Schnabel, Jr. | 405/262 |
| 5,253,959 | A * | 10/1993 | MacDonald et al. | 405/279 |
| 5,368,414 | A * | 11/1994 | Miller | 405/262 |
| 6,023,901 | A * | 2/2000 | Jensen | 52/514 |
| 6,135,674 | A * | 10/2000 | Neilson | 405/259.1 |
| 6,238,143 | B1 * | 5/2001 | Zablonski | 405/259.1 |
| 6,332,303 | B1 * | 12/2001 | Saito | 52/741.14 |
| 6,669,420 | B2 * | 12/2003 | Ikuta | 411/340 |
| 6,769,222 | B2 * | 8/2004 | Billante | 52/741.15 |
| 6,908,258 | B2 * | 6/2005 | Timmerman | 405/31 |
| 6,939,084 | B2 * | 9/2005 | Kulchin | 405/259.1 |
| 7,517,175 | B2 * | 4/2009 | Timmerman | 405/262 |
| 7,681,367 | B2 * | 3/2010 | Morton et al. | 52/291 |
| 7,862,259 | B2 * | 1/2011 | Carpenter | 405/302.7 |
| 8,375,671 | B1 * | 2/2013 | Thrasher et al. | 52/514 |
| 2009/0025328 | A1 * | 1/2009 | Hemminger et al. | 52/514 |

OTHER PUBLICATIONS

Brochure for GRIP-TITE wall anchor system, Grip-Tite Manufacturing Co., Inc., copyright 1995, 4 pages.

* cited by examiner

*Primary Examiner* — Brian Glessner
*Assistant Examiner* — Joseph J Sadlon
(74) *Attorney, Agent, or Firm* — Skaar Ulbrich Macari, P.A.

(57) ABSTRACT

In general, the present invention is directed to anchoring devices, and more specifically to a wall anchoring device and method of installing same requiring no soil excavation.

14 Claims, 3 Drawing Sheets

DETAIL B

DETAIL D
26
12
14
28
SEE DETAIL D
24
10
20
12
16
18
SEE DETAIL B

WALL ANCHORING DEVICE AND METHOD OF INSTALLATION REQUIRING NO SOIL EXCAVATION

CROSS-REFERENCE TO RELATED APPLICATIONS

This application claims the benefit of U.S. Provisional Patent Application No. 61/628,511, filed Nov. 1, 2011, the disclosure of which is incorporated herein by reference in its entirety.

FIELD OF THE INVENTION

In general, the present invention is directed to anchoring devices, and more specifically to a wall anchoring device and method of installing same requiring no soil excavation.

BACKGROUND

A very common problem with many below ground basement walls is that water tends to build up on the outside of such basement walls which causes a very high hydrostatic pressure against the wall. If this pressure becomes significant, it causes the wall to be pushed into the basement to some extent. Commonly, a large horizontal crack will appear in the wall. Besides the obvious problem of the unsightly nature of the crack, it will also permit water into the basement and if the hydrostatic pressure continues to increase the wall could eventually collapse.

The main reason a walls lateral strength is compromised is due to poor drainage or negative grade adjacent to the basement wall. When it rains or snow melts, this water accumulates next to the wall rather than draining away over the surface. When water is allowed to collect next to the wall it soaks into the soil, such that when the moisture content of expansive soil is increased, the soil expands. This expansion can put large amounts of stress on the side of the wall causing it to break in the middle and bow in. At this point, the lateral strength of the wall is compromised leaving it susceptible to failure especially if large amounts of rain or melting snow persist. When the soil undergoes significant expansion when wet and shrinkage when it dries, this can create a gap between the wall and the soil, the gap usually fills with loose soil adding to the negative grade causing magnifying the problem. It becomes a vicious cycle, and over time the wall is sure to fall in. The grade eventually gets worse causing more of a soaking action, causing more stress on the wall. When a wall anchor is installed and the grade raised, the walls lateral strength may be restored, and it can resist the forces exerted by the expanding soil. When the climate cycles through wet and dry periods, the soils natural expansion and contraction is thereby minimized because the water runs away leaving the soil adjacent to the wall to have a relatively consistent moisture content. Given this, wall anchors need to be adjustable allowing them to be tightened during dry weather. When the soil dries, it shrinks away from the wall leaving a gap, so the wall can easily be pulled straight by tightening the anchors.

The most common accepted methods and apparatus for straightening a basement wall are illustrated in U.S. Pat. Nos. 4,189,891 and 4,970,835.

The former patent relates to a method for anchoring and straightening a wall wherein a hole is formed in the ground at a distance from the wall and an opening is provided in the wall from the inside below ground level. Then an elongated rod member is positioned through the opening in the wall and forced through the ground so that one end of the member extends into the hole previously formed. An anchor structure, such as an anchor plate, is secured to one end of the rod member in the hole, and a wall plate is attached to the other end of the elongated rod member inside and against the wall. The wall plate is then forced against the wall by use of a threaded attaching mechanism for thereby straightening the wall.

The wall anchoring and straightening device of the latter referenced patent is in many ways similar but eliminates the need for digging the hole into the earth at a spaced distance from the wall. This device comprises a horizontal elongated rod member having a chisel point end which is driven through the foundation wall into the earth and carries a plurality of pivotal spade arms adjacent the chisel point. The end of the rod member, which is positioned at the interior of the wall, is provided with threads. In similar fashion, a wall plate is forced against the wall by a nut which is tightened to pull the rod member and chisel arm and spade arms closer to the foundation wall which thereby firmly causes the spade arms to spread and dig into the surrounding earth to provide an anchor. Further tightening of the nut causes the wall plate to be forced against the wall and to straighten the wall.

SUMMARY OF THE INVENTION

A below ground wall anchor and straightening device requiring no earth excavating is disclosed comprising an elongated rod driven into earth soil, means to submerge an earth anchor in earth soil mating with the elongated rod, earth anchoring means mechanically secured to the distal end of the elongated rod; a brace plate secured to the inside of the basement wall to be straightened, the proximal end of said elongated rod mechanically secured to said brace plate by adjustable threaded fastener, modifying the straightening force to the basement wall by adjusting the threaded fastener, and said threaded fastener having pivot capability so as to not bind when being adjusted.

A method of straightening a below ground basement wall comprising: mechanically driving an elongated rod into earth soil at a downward angle relative to the horizontal, calculating the position of the distal end of the elongated rod embedded in earth soil, mechanically driving an earth anchor device downward into the earth at an appropriate position to mechanically mate with the distal end of the elongated rod, securing a brace plate to the inside of the basement wall in mechanical communication with the proximal end of the elongated rod by means of a pivotable threaded fastener; and adjusting the pivotable threaded fastener to supply a sufficient restoring force to straighten the basement wall.

BRIEF DESCRIPTION OF THE DRAWINGS

The invention may be more completely understood in consideration of the following detailed description of various embodiments of the invention in connection with the accompanying drawings, in which.

Figures 1A, 1B, 1C:
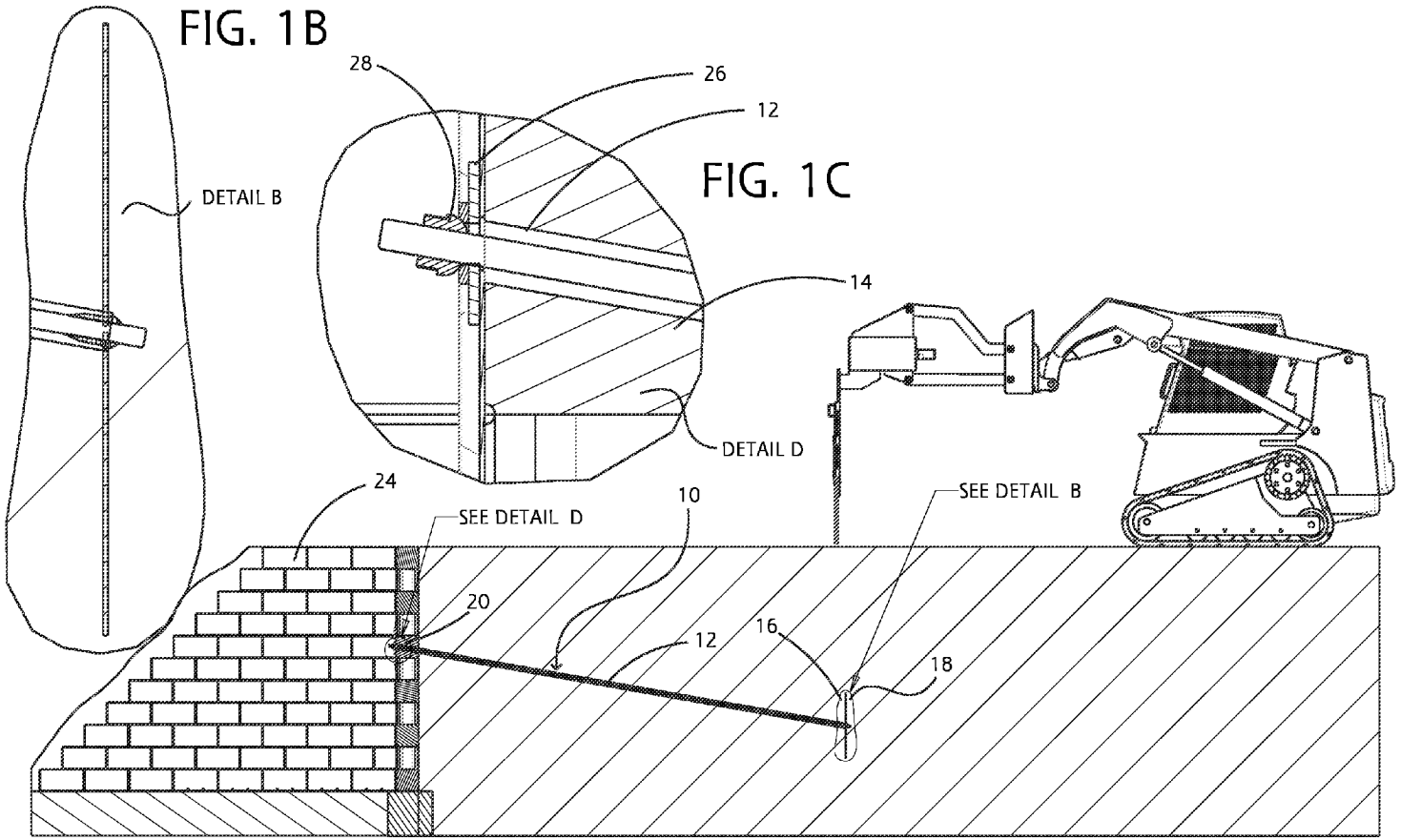
FIGS. 1A-1C show schematic representations of one embodiment of the present invention depicting a wall anchoring and straightening device highlighting the components to anchor the straightened wall.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In general, the present invention is directed to anchoring devices, and more specifically to a wall anchoring device and method of installing same.

One embodiment of the present invention is depicted in FIG. 1 wherein a wall anchor device 10 and the equipment for installing same are shown schematically. As shown in FIG. 1, an elongated rod 12 is embedded in earth soil 14 being mechanically attached on its distal end 16 to an earth anchor device 18, and mechanically attached on its proximal end 20 to a wall brace device 22. The earth anchor device 18 may be driven into the earth soil 14 by mechanical means to mate with the earth anchor device 18 without the need to first excavate earth soil 14.

In one particular embodiment of the present invention, the first step in installing the wall anchor device 10 is to mechanically drive the elongated rod 12 into the earth soil 14. The entrance point for the elongated rod 12 in the basement wall 24 may be approximately twenty-four inches down as estimated from outside ground level. The mechanical means for driving the elongated rod 12 into the earth soil 14 may be a jackhammer type device or any alternative device with sufficient driving force. The elongated rod 12 may be fabricated from galvanized steel or similar high strength material with a threaded diameter in the range of 1/2 inch to 1 inch, and lengths ranging from 6 feet to 30 feet, with 12 feet being a typical span. In one embodiment of the present invention the elongated rod 12 may be mechanically driven into the earth soil 14 at a negative angle with respect to the horizontal as depicted in FIG. 1. In one such embodiment, the negative angle may be approximately 15 degrees downward as measured from the horizontal.

In a preferred embodiment of the present invention, the earth anchor device 18 may be may be driven into the earth soil 14 without the need to first excavate earth soil 14, by a skid steer loader device or other such device capable thereof configured with an adapter 30 (see FIG. 2) to hold the said earth anchor. Prior to embedding the earth anchor device 18, the installation team may first calculate the approximate position of the distal end of the elongated rod 12 already embedded in earth soil 14 by way of simple geometry. The installation team may then calculate a small safety margin to anticipate interfacing the earth anchor 18 with the already embedded elongated rod 12 a few inches retracted from its most distal end.

Figures 2A, 2B, 2C:
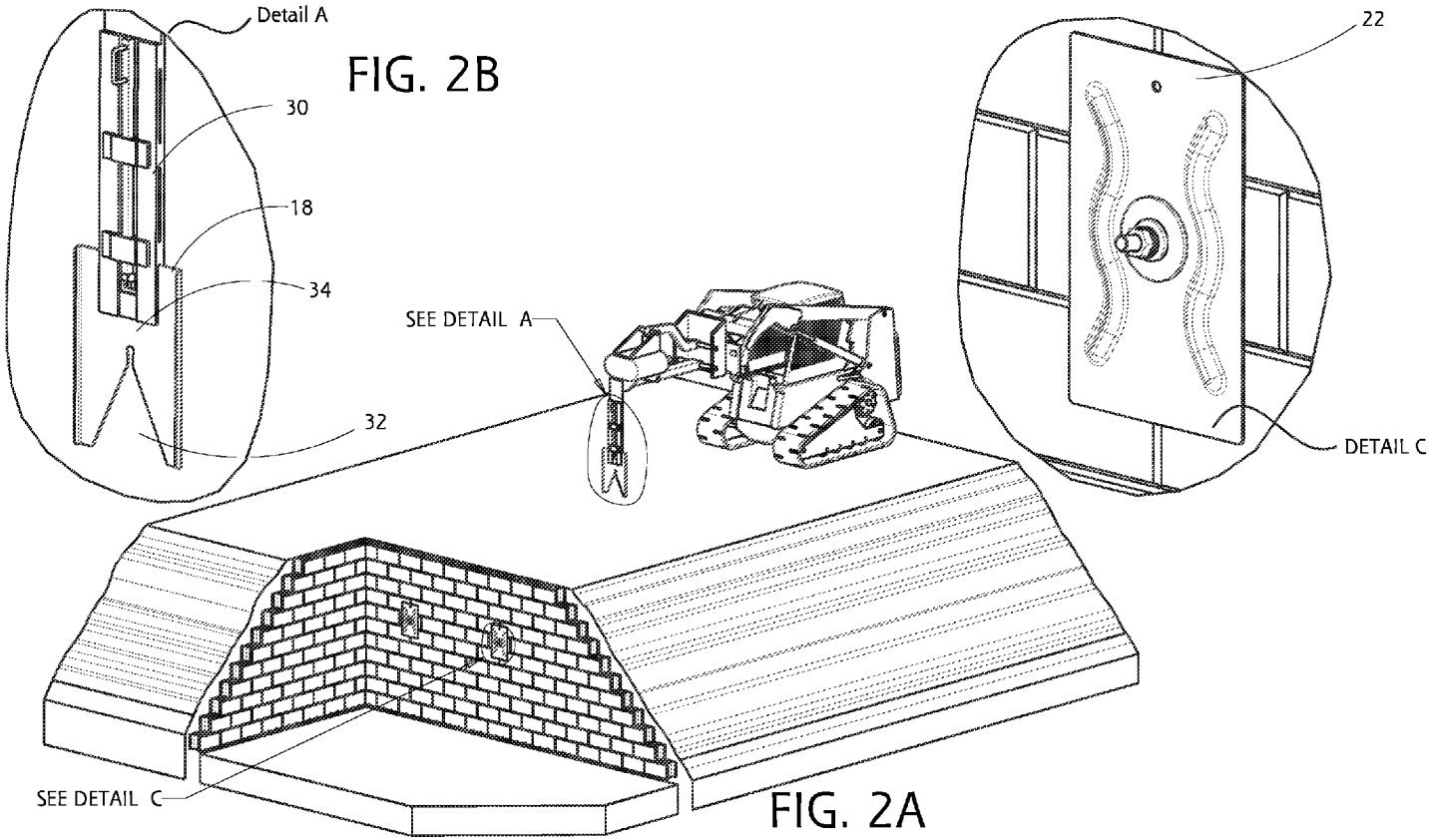
FIGS. 2A-2C show schematic representations of the embodiment of the present invention depicted in FIG. 1 highlighting the individual components that install the earth anchoring device.
Figures 3A, 3B, 3C, 3D:
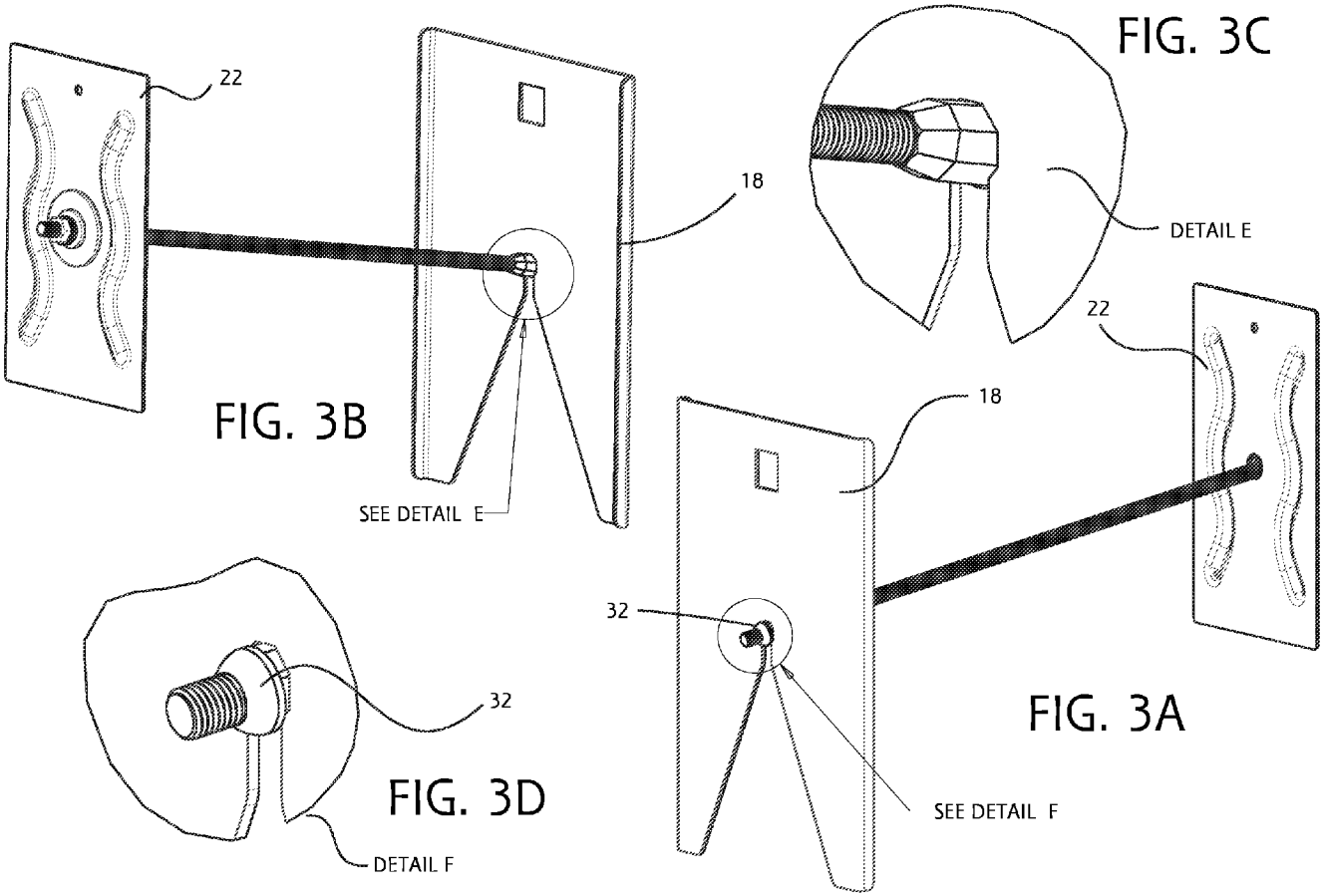
FIGS. 3A-3D show schematic representations of the embodiment of the present invention depicted in FIG. 1 highlighting the individual components that supply the restoring force to straighten the wall.

As shown in FIG. 2, the earth anchor device 18 may be configured with a groove 32 to aid in interfacing with the already embedded elongated rod 12 during driving the earth anchor downward into earth soil. Once the operator of the skid steer loader device senses the earth anchor 18 has interfaced with the embedded elongated rod 12 a sufficient distance to place the elongated rod in the extreme recessed region 34 of the earth anchor 18, the Bobcat downward driving thrust may be terminated, and the adapter 30 may be disengaged from the earth anchor 18 and retracted. As shown in FIG. 3, the extreme distal end of the elongated rod 12 has incorporated a reinforcing element 32 comprising a tapered nut to securely interlock with the extreme recessed region 34 of the earth anchor 18. At this point it has been determined that the earth anchor 18 is properly positioned that the elongated rod 12 is positioned in the extreme recessed region 34 of the earth anchor, work now shifts to the inside wall of the basement.

A wall brace device 22 is now installed over the proximal end of the elongated rod 12 protruding out of the basement wall 24. A threaded fastener 28 consisting of a pivotable washer and tightening nut are threaded onto the extreme proximal end of the elongated rod 12, now itself protruding out of the wall brace device 22. Utilizing a torque wrench or similar such device, the threaded fastener 28 is tightened so as to begin applying a restoring force to the wall brace device 22 and therefore ultimately to the basement wall 24. As mentioned earlier, the extreme distal end of the elongated rod 12 has incorporated a reinforcing element 32 comprising a tapered nut to securely interlock with the extreme recessed region 34 of the earth anchor 18. As the threaded fastener 28 is first tightened, the reinforcing element 32 (which was originally located a few inches removed from the earth anchor device 18) is drawn proximate to the earth anchor device 18 and ultimately securely interlocked thereto. With the reinforcing element 32 now securely interlocked with the earth anchor device 18, continued torqueing of the threaded fastener 28 may supply direct restoring force to the basement wall 24.

As mentioned earlier, the elongated rod 12 may be mechanically driven into the earth soil 14 at a negative angle with respect to the horizontal as depicted in FIG. 2. Given this, a disadvantage of many prior art devices is that the threaded fastener 28 may bind prior to reaching the desired ultimate torque due to the angle between the surface of a standard planar washer and the basement wall 24. In a preferred embodiment of the present invention, the pivotable washer and tightening nut accommodates this angular offset by incorporating an oval shaped and angled inner-walled surface to the pivotable washer thereby allowing the threaded fastener 28 to pivot and maintain flush contact with the basement wall 24. The tightening process of the threaded fastener 28 may proceed until an optimum torque of 80 foot pounds may be achieved (typical ranges span 60 to 120 foot pounds) to restore the basement wall 24 to a vertical orientation.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

I claim:

1. A wall anchor system, comprising:

an elongated rod having a first end and a second end;

an earth anchor plate configured to engage the first end of the elongated rod, the earth anchor plate comprising a generally rectangular body having a top end, an opposing bottom end and sides spanning between the top and bottom ends, wherein a recessed groove is defined from the bottom end and extending into the body towards the top end by a first converging side and a second converging side that converge towards one another from the bottom end towards the top end; the recessed groove engaging the elongated rod and a wall brace, comprising a generally planar body including an aperture defined therein to permit the second end of the elongated rod to be inserted there through.

2. The wall anchor system of claim 1, wherein the earth anchor plate further includes an interlocking zone defined in the earth anchor body adjacent the recessed groove.

3. The wall anchor system of claim 1, wherein the earth anchor plate is generally planar and includes outwardly extending flanges along the sides of the earth anchor body.

4. The wall anchor system of claim 1, wherein the wall brace body is generally rectangular and has a top edge, an opposing bottom edge and side edges spanning between the top and bottom edges.

5. The wall anchor system of claim 4, wherein the wall brace body includes outwardly extending flanges along the sides thereof.

6. The wall anchor system of claim 1, further comprising a pivotable washer and tightening nut configured to be disposed on the second end of the elongated rod and accommodate angular offset of the elongated rod with respect to a line normal to the generally planar body of the wall brace.

7. The wall anchor system of claim 1, wherein the earth anchor body comprises more than 200 square inches of area bounded by the top, bottom and side.

8. A method of anchoring a basement wall without the need for excavating soil, comprising:

driving an earth anchor plate into unexcavated soil to engage an anchor rod disposed in the unexcavated soil until an engagement groove in the earth anchor plate engages a distal end of the anchor rod;

disposing a brace plate over a proximal end of the anchor rod adjacent the basement wall; and tightening a fastener on the proximal end of the anchor rod to draw the rod towards the basement wall until the distal end of the anchor rod interlocks with the wall anchor plate.

9. The method of claim 8, wherein the fastener comprises a pivotable washer and tightening nut, the method further comprising disposing a pivotable washer and tightening nut on the proximal end of the anchor rod prior to the step of tightening the fastener.

10. The method of claim 8, further comprising calculating a location of the distal end of the anchor rod located in the unexcavated soil.

11. The method of claim 8, further comprising deflecting the earth anchor plate laterally during the step of driving by contacting a converging side of the groove against the anchor rod.

12. A method of anchoring a basement wall without the need for excavating soil, comprising:

driving an anchor rod from inside of a basement outward through the basement wall and into unexcavated soil outside of the basement at a downward angle with respect to horizontal;

calculating a location of a distal end of the anchor rod located in the unexcavated soil driving an earth anchor plate into the unexcavated soil at a location determined from the step of calculating the location of the distal end of the anchor rod;

engaging a groove in the earth anchor plate with the distal end of the anchor rod;

disposing a brace plate over a proximal end of the anchor rod inside of the basement tightening a fastener on the proximal end of the anchor rod to draw the rod towards the basement wall until the distal end of the anchor rod interlocks with the earth anchor plate; and tightening the fastener further to supply a restoring force to the basement wall.

13. The method of claim 8, wherein the fastener comprises a pivotable washer and tightening nut, the method further comprising disposing a pivotable washer and tightening nut on the proximal end of the anchor rod prior to the step of tightening the fastener.

14. The method of claim 8, further comprising deflecting the earth anchor plate laterally during the step of driving by contacting a converging side of the groove against the anchor rod.

* * * * *